US009737140B2

(12) United States Patent
Bondi

(10) Patent No.: US 9,737,140 B2
(45) Date of Patent: Aug. 22, 2017

(54) HOUSEHOLD OBJECT STORAGE SYSTEM

(71) Applicant: Michael A. Bondi, Blaine, MN (US)

(72) Inventor: Michael A. Bondi, Blaine, MN (US)

( * ) Notice: Subject to any disclaimer, the term of this patent is extended or adjusted under 35 U.S.C. 154(b) by 0 days.

(21) Appl. No.: 14/852,971

(22) Filed: Sep. 14, 2015

(65) Prior Publication Data

US 2016/0073775 A1 Mar. 17, 2016

Related U.S. Application Data

(60) Provisional application No. 62/049,556, filed on Sep. 12, 2014.

(51) Int. Cl.

| | |
|---|---|
| ***A47B 51/00*** | (2006.01) |
| ***A47B 43/00*** | (2006.01) |
| ***A47B 46/00*** | (2006.01) |
| ***A47F 5/08*** | (2006.01) |

(52) U.S. Cl.

CPC ..... *A47B 51/00* (2013.01); *A47B 43/006* (2013.01); *A47B 2051/005* (2013.01)

(58) Field of Classification Search

CPC .. A47B 51/00; A47B 2051/005; A47B 43/006
USPC ..... 211/17, 18, 85.29, 113, 117, 118, 209; 248/320, 328, 329, 331, 332, 581; 254/338

See application file for complete search history.

(56) References Cited

U.S. PATENT DOCUMENTS 493,596 A * 3/1893 McLeran ..... A47F 5/0892 211/117
787,277 A * 4/1905 Carter ..... B66D 3/06 211/117
983,957 A * 2/1911 Trantham ..... B66D 3/04 254/338
1,066,371 A * 7/1913 Bosworth ..... A47F 5/0892 211/117
1,185,167 A * 5/1916 Bishop ..... A47F 5/0892 211/117
1,202,166 A * 10/1916 Corbett ..... A47F 5/0892 211/117

(Continued)

FOREIGN PATENT DOCUMENTS

DE 9213902 U1 * 12/1992 ..... A47B 51/00
DE 29700379 U1 * 8/1997 ..... A47B 51/00
FR 2635794 A1 * 3/1990 ..... D06F 57/125

OTHER PUBLICATIONS

"Definition of Join", Webster's New Basic Dictionary, 2007, Houghton Mifflin Company, p. 389.*

*Primary Examiner* — Stanton L Krycinski
(74) *Attorney, Agent, or Firm* — Michael A. Bondi; Moss & Barnett

(57) ABSTRACT

A household object storage system for storing objects in an elevated position within a building. The household object storage system includes a platform and a lift system. The platform has a surface upon which at least one household object may be placed. The lift system includes at least one platform attachment, at least one building attachment, a winch and a rope. The at least one platform attachment is attachable to the platform. The at least one building attachment is attachable to the building. The winch is attachable to the building. The rope operably engages the platform attachment, the building attachment and the winch so that the winch may be used to move the platform between a lower configuration and an elevated configuration.

14 Claims, 3 Drawing Sheets

(56) References Cited

U.S. PATENT DOCUMENTS 5,051,027 A * 9/1991 Horton ..... B63C 3/06 114/44
5,984,275 A * 11/1999 Hoslett ..... B60J 11/00 248/327
6,056,274 A * 5/2000 Naas ..... B66D 3/04 248/317
6,152,427 A * 11/2000 Hoslett ..... B60J 11/00 248/327
6,361,022 B1 * 3/2002 Lob ..... B66C 13/02 114/44
6,386,515 B1 * 5/2002 Sachtleben ..... B66D 1/04 248/320
6,959,918 B1 * 11/2005 Samuels ..... B60J 7/106 248/327
7,325,785 B2 * 2/2008 Krengel ..... A47B 5/00 211/17
7,527,242 B2 * 5/2009 Shaha ..... B66D 3/04 182/144
8,056,883 B1 * 11/2011 Brockie ..... B66D 3/04 254/278
8,162,159 B2 * 4/2012 Carter ..... A47B 46/005 108/145
8,245,651 B1 * 8/2012 Mikich ..... A47B 5/00 108/42
8,544,823 B2 * 10/2013 Imberi ..... B66D 1/36 254/338
2007/0029267 A1 * 2/2007 Hall ..... B62H 3/12 211/17
2007/0176524 A1 * 8/2007 Plano ..... A47B 77/04 312/247
2012/0061544 A1 * 3/2012 Boda ..... B62H 3/12 248/329
2015/0272323 A1 * 10/2015 Klooth ..... A47B 51/00 182/144

* cited by examiner

HOUSEHOLD OBJECT STORAGE SYSTEM

REFERENCE TO RELATED APPLICATION

This application claims priority to U.S. Provisional Application No. 62/049,556, which was filed on Sep. 12, 2014, the contents of which are incorporated herein by reference.

FIELD OF THE INVENTION

The invention relates to a system for storing objects. More particularly, the invention relates to a household object storage system.

BACKGROUND OF THE INVENTION

Many homes include garages that in addition to storing vehicles are used to store objects such as lawn mowers. It is also common to store home maintenance implements, sports equipment and holiday decorations in garages. Depending on the amount of these additional objects, the available space in the garage may be reduced to a significant extent such that it is not possible to store the vehicles in the garage. Especially in colder climates, it may be undesirable to leave the vehicles outside of the garage.

In an effort to increase the efficiency at which objects are stored in the garage, various shelving systems have been developed. However, these shelving systems may have limited usefulness in conjunction with heavy objects that the person cannot lift onto the storage system or large objects that are too big to be placed on the storage system.

What is needed is a household object storage system that enables large and/or heavy objects to be easily and safely raised above the floor to thereby increase the efficiency at which the objects are stored in the garage.

SUMMARY OF THE INVENTION

An embodiment of the invention is directed to a household object storage system for storing objects in an elevated position within a building. The household object storage system has a platform and a lift system. The platform has a surface upon which at least one household object may be placed. The lift system includes at least one platform attachment, at least one building attachment, a winch and a rope. The at least one platform attachment is attachable to the platform. The at least one building attachment is attachable to the building. The winch is attachable to the building. The rope operably engages the platform attachment, the building attachment and the winch so that the winch may be used to move the platform between a lower configuration and an elevated configuration.

Another embodiment of the invention is directed to a method of storing household objects in an elevated position within a building. A platform is provided that has a surface upon which at least one household object may be placed. At least one platform attachment is attached to the platform. At least one building attachment is attached to the building. A winch is attached to the building. A rope operably engages the platform attachment, the building attachment and the winch. At least one object is placed on the platform. The platform is moved between a lower configuration and an elevated configuration with the winch.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to a household object storage system. The household object storage system is particularly suited for use in storing objects in a garage. The household object storage system enables the objects to be moved to an elevated location in the garage such that the amount of occupied space in the garage is reduced.

For example, the household object storage system can be used in storing seasonal items such as holiday decorations in a manner that allows the seasonal items to be readily accessed. The household object storage system can also be used to store a lawn mower. In certain embodiments, the lawn mower can be stored on the household object storage system during an extended period of time in which it is not needed to use the lawn mower such as during the winter in a cold climate. Alternatively, in garages where there is very limited space, the lawn mower can be stored in an elevated position using the household object storage system between the times at which the lawn mower is used.

The household object storage system 10 generally includes a platform 12 and a lift system 14, as illustrated in the figures. The platform 12 is fabricated with a length and a width based upon a size of the object that is intended to be stored on the household object storage system 10.

In certain embodiments, the platform 12 may have a generally square or rectangular configuration with each side having a length of between about 12 inches and about 72 inches. In other embodiments, the platform 12 is generally square with sides having a length of about 48 inches.

The platform 12 may be fabricated from a variety of materials using the concepts of the invention. The platform 12 should have sufficient structural rigidity such that the platform resists bending and breakage while the object is stored in the elevated position on the household object storage system 10.

Figure 3:
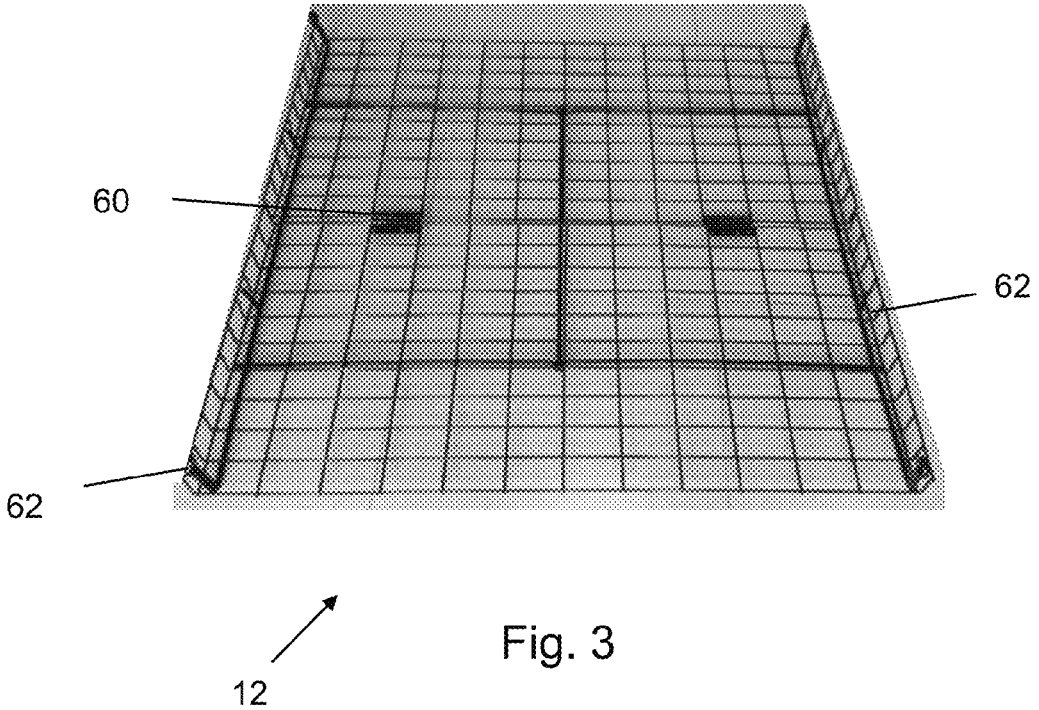
FIG. 3 is a perspective view of an alternative embodiment of the platform.

In certain embodiments, the platform 12 is fabricated from a polymeric material. An advantage of using the polymeric material is that the platform 12 can have a relatively light weight. An example of one technique that may be used to fabricate the platform 12 from the polymeric material is blow molding. In other embodiments, the platform 12 may be fabricated from either a metal sheet or an interconnected wire frame, as illustrated in FIG. 3.

The platform 12 may have a side wall or edge 20 around at least a portion of the platform 12. The side wall 20 reduces the potential of the object inadvertently moving off of the platform 12 when stored thereon. In certain embodiments, the side wall 20 is oriented generally transverse to the platform 12.

While the side wall 20 should have a height that is sufficiently large to prevent the object from inadvertently moving off the platform 12, the side wall should not be too large to make it challenging to place objects on to the platform. In certain embodiments, the side wall 20 has a height of up to about 3 inches. The side wall 20 may be integrally formed with the other portions of the platform 12. In other embodiments, the side wall 20 is fabricated separately from the platform 12.

In other embodiments, the side wall 20 has a height that is close to or greater than the height of the objects that are desired to be placed on the platform 12. This configuration may facilitate placing loose objects on the platform 12.

In this embodiment, the side wall 20 has a height of between about 6 inches and about 24 inches. In an alternative configuration, the side wall 20 has a height of between about 12 inches and about 18 inches.

The side wall 20 in this embodiment may be pivotally attached to the platform 12 so that the side wall 20 may be folded to an orientation that is generally parallel to the platform 12 for shipping and retailing. Alternatively, the side wall 20 may be removably attached to the platform 12. A person of skill in the art will appreciate that a variety of techniques such as screws and zip strips may be used to attach the side wall 20 to the platform 12.

The household object storage system 10 may also include a lid (not shown) that is attached to at least one of the platform 12 or the side wall 20. The lid may be operably attached for movement between an open configuration. The lid may be fabricated from the same material that is used to fabricate the platform 12 or the side wall 20.

A security strap or fastening system 22 can also be used in conjunction with the platform 12. In certain embodiments, the fastening system 22 is a rope that extends at least partially around the object placed on the platform 12. Opposite ends of the rope may be attached to the platform 12 such as using a hook. In certain embodiments, at least a portion of the fastening system 22 may be fabricated from a resilient material that is stretched when extended over the object that is placed on the platform 12.

The lift system 14 may include at least one rope 30 that is used to attach the platform 12 to the building in which the household object storage system 10 is used. In certain embodiments, one of the ropes 30 is attached to the platform 12 proximate each corner thereof.

Figure 1:
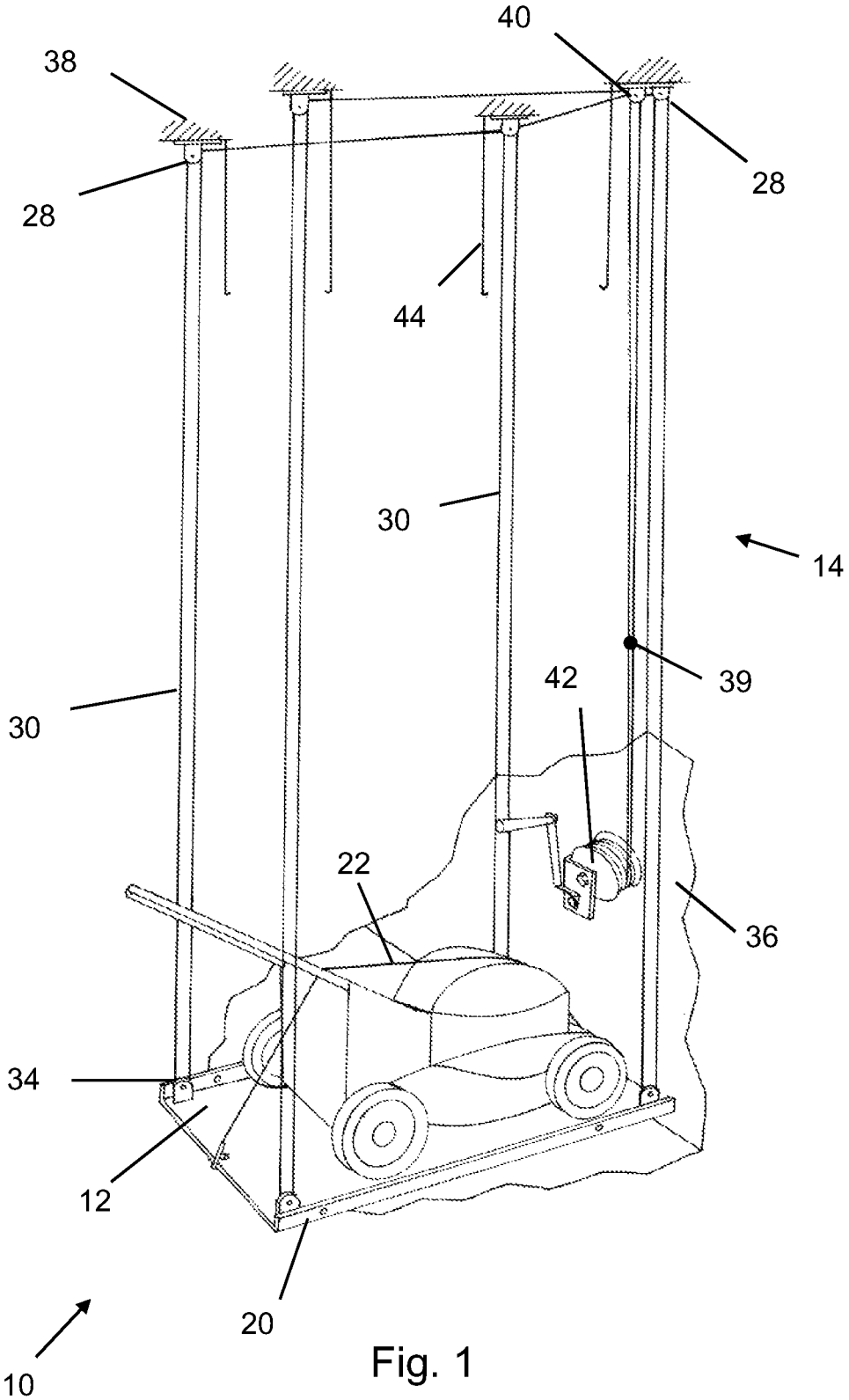
FIG. 1 is a perspective view of a household object storage system according to an embodiment of the invention where a platform is in a lowered position.
Figure 2:
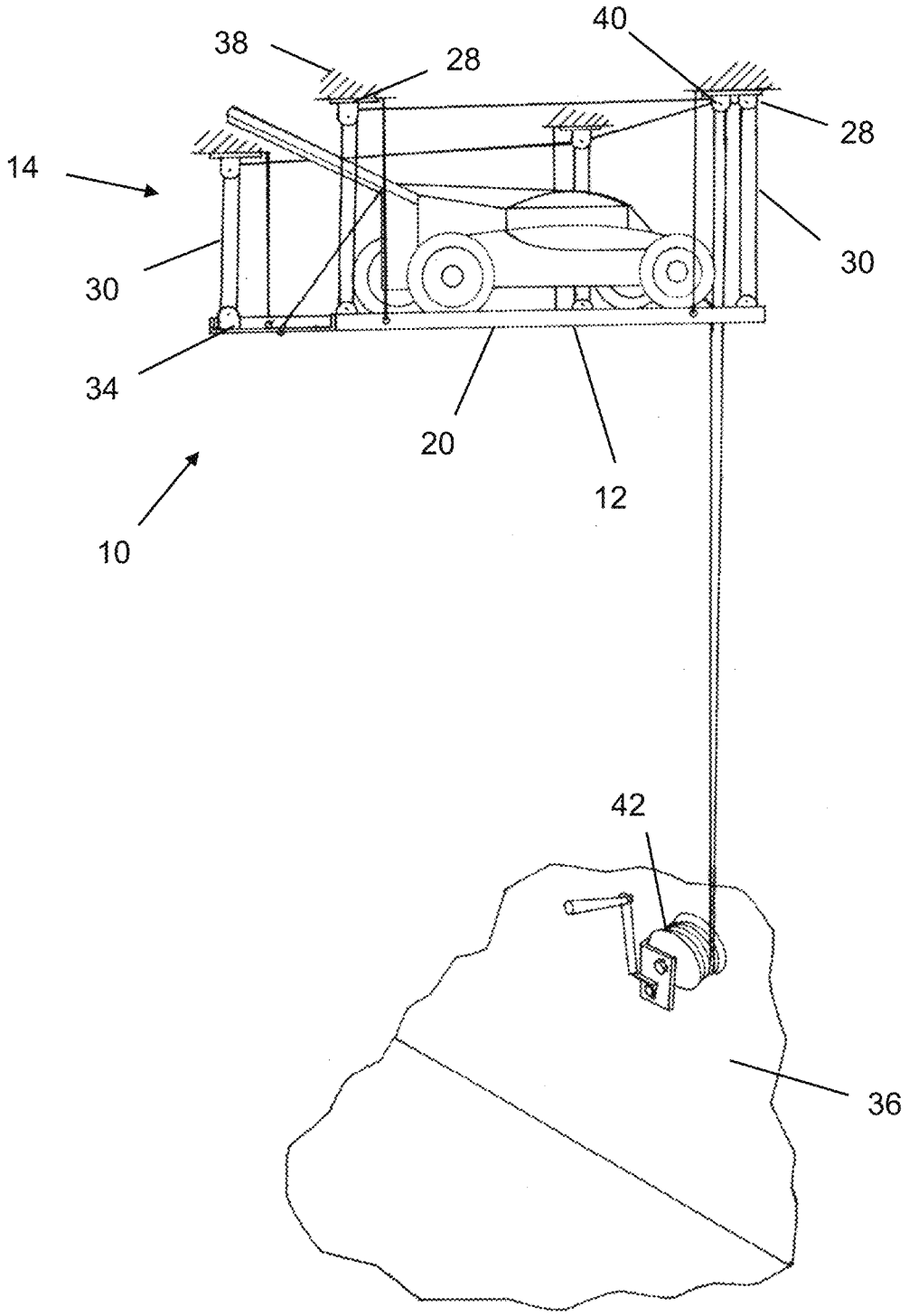
FIG. 2 is a perspective view of the household object storage system where the platform is in a raised position.

FIGS. 1 and 2 illustrate that an end of the rope 30 is attached to the ceiling 38 either directly or using a ceiling attachment and then extends around pulley 34 and then back to the ceiling around pulley 28 that is operably attached to the ceiling attachment. This configuration provides a mechanical advantage by reducing the amount of force needed to raise and lower the platform 12. It is also possible to attach the ends of the rope 30 to the platform and then have the rope 30 pass through the pulley 28 mounted to the ceiling. A person of skill in the art will appreciate that a variety of techniques may be used to attach the ends of the ropes to either the ceiling or the platform.

Depending on the anticipated weight of the object that is to be stored using the household object storage system 10, the rope 30 may be operably attached to the platform using a pulley 34 with an end of the rope 30 being secured to the building. Such a configuration reduces a force that is needed to lift the object that is placed on the platform 12.

Alternatively, when the anticipated capacity of the objects to be stored on the platform 12 is relatively low, the rope 30 may pass through a loop that is attached to the platform 12 or around one of the structural elements of the platform 12.

In certain embodiments, the ropes 30 attached to each of the corners of the platform 12 can be attached together such as at point 39 the four ropes join together prior to attachment to the winch. Using such a configuration facilitates pulling the ropes 30 in unison to maintain the platform 12 in a substantially horizontal orientation throughout the lifting process.

It is possible for an additional pulley 40 to be provided proximate the intersection of the ceiling 38 to which the ropes 30 are attached and the side wall 36. The additional pulley 40 causes the ropes 30 to be positioned proximate the ceiling 38 and the side wall 36 to reduce the potential of the ropes interfering with the use of the building for other activities.

A pulley 28 may be attached to the ceiling 38 to enhance the ability to pull the rope 30 when raising and lowering the platform 12. As an alternative to using the various pulleys in the invention, it is possible to use a support having a low friction surface.

An end of the rope 30 opposite the platform 12 may be removably attached to a side wall 36 of the building such that a person who desires to use the household object storage system 10 can grasp the end of the rope 30 while standing on a ground surface.

Depending on the anticipated weight of the object that is to be lifted using the household object storage system 10, it may be possible to use a winch 42 to facilitate raising and lowering the platform 12. The winch 42 may have a hand crank that facilitates rotating the spool.

A variety of mechanisms may be used for operably attaching the hand crank to the spool. An example of one suitable technique is a worm gear. An advantage of using the worm gear is that it causes the spool to resist unintentional rotation. Alternatively or additionally, the winch 42 may include a braking mechanism to prevent unintentional rotation of the spool.

As an alternative to the hand crank, a powered device such as a drill (not shown) may be used to cause the ropes 30 to be pulled when raising or lowering the platform 12. In such a configuration, the ropes 30 may be wrapped around a spool or other cylindrical device. It is also possible to use at least one gear to control a rate at which the platform 12 is raised or lowered and/or to increase the torque provided to the spool.

To reduce the potential of the platform 12 being inadvertently lowered from the elevated position, at least one security strap 44 may be attached to the ceiling 38. A lower end of the security strap 44 may include a hook 46 that is engaged to the platform 12 once the platform 12 is in the elevated position. In certain embodiments, one of the security straps 44 is provided proximate each of the corners of the platform 12. Depending on the height of the platform 12 when in the elevated position, it may be necessary for the person to stand on a ladder when engaging and disengaging the hooks 46 and the platform 12.

In another embodiment, the platform 12 is fabricated in two sections that are operably attached to each other such as illustrated in FIG. 3. Forming the platform 12 in two sections may enable the platform to more easily distributed, marketed and transported by a purchaser. The platform sections may have a similar size. In certain embodiments, the platform sections are pivotally attached to each other using at least one hinge 60.

Figure 4:
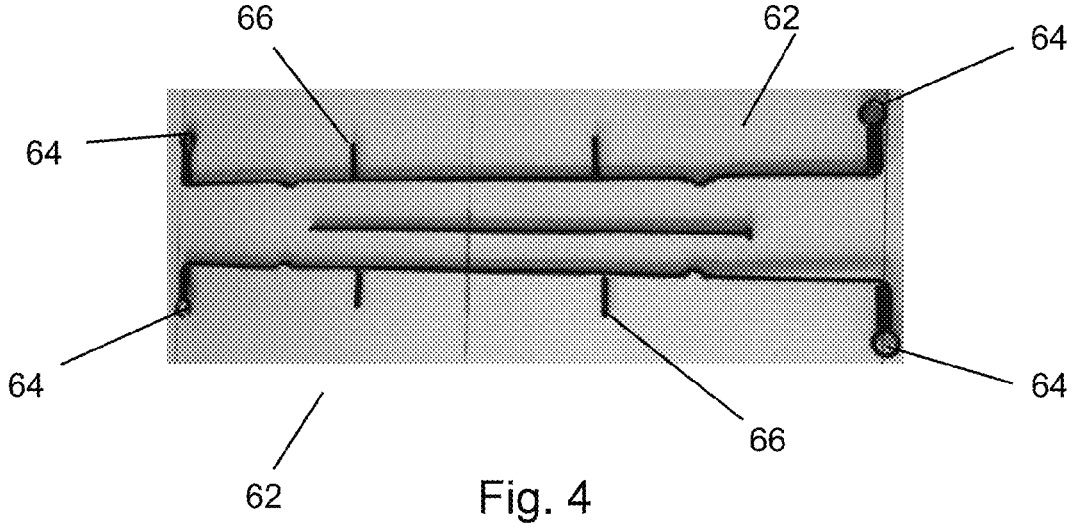
FIG. 4 is a side view of supports that are used in the platform illustrated in FIG. 3.

To maintain the platform in a generally planar configuration, at least one support 62, which is illustrated in FIG. 4, may be provided. The support 62 may have an eyelet 64 proximate opposite ends thereof to which the rope 30 is attached. At least one extension 66 may be provided at an intermediate location on the support 62. The extension 66 may be oriented generally transverse to the support 62 and have a length that is less than a height of the side wall. When the support 62 is attached to the platform 12, the extension 66 may extend between one of the wires that form the platform 12 and/or the side wall to thereby facilitate maintaining the support 62 at a desired location with respect to the platform.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A household object storage system for storing objects in an elevated position within a building, wherein the household object storage system comprises:

a platform having a surface upon which at least one household object can be placed; and a lift system comprising:

first, second, third and fourth platform attachments that are each attached to the platform;

first, second, third and fourth building attachments that are each attached to the building;

a winch that is attached to the building; and a first rope that operably engages the first platform attachment, the first building attachment and the winch;

a second rope that operably engages the second platform attachment, the second building attachment and the winch;

a third rope that operably engages the third platform attachment, the third building attachment and the winch; and a fourth rope that operably engages the fourth platform attachment, the fourth building attachment and the winch so that the winch can be used to move the platform between a lower configuration and an elevated configuration wherein the first, second, third and fourth ropes are attached together prior to attachment to the winch.

2. The household object storage system of claim 1, wherein the the first, second, third and fourth ropes each have a first end and a second end, wherein the first end of the first, second, third and fourth ropes is attached to the respective platform attachment, wherein the second end of the first, second, third and fourth ropes is attached to the winch and wherein the first, second, third and fourth ropes slidably engage the respective building attachment.

3. The household object storage system of claim 1, wherein the the first, second, third and fourth ropes each have a first end and a second end, wherein the first end of the first, second, third and fourth ropes is attached to the respective building attachment, wherein the second end of the first, second, third and fourth ropes is attached to the winch and wherein the first, second, third and fourth ropes slidably engage the respective platform attachment and the respective building attachment.

4. The household object storage system of claim 1, and further comprising at least one pulley attached to the building, wherein the first, second, third and fourth ropes engage the at least one pulley intermediate the respective building attachment and the winch.

5. The household object storage system of claim 1, wherein the platform in fabricated in at least two sections that are pivotally attached to each other.

6. A household object storage system for storing objects in an elevated position within a building, wherein the household object storage system comprises:

a platform having a surface upon which at least one household object can be placed; and a lift system comprising:

first, second, third and fourth platform attachments that are each attached to the platform;

first, second, third and fourth building attachments that are each attached to the building;

a winch that is attached to the building;

a first rope that operably engages the first platform attachment, the first building attachment and the winch;

a second rope that operably engages the second platform attachment, the second building attachment and the winch;

a third rope that operably engages the third platform attachment, the third building attachment and the winch; and a fourth rope that operably engages the fourth platform attachment, the fourth building attachment and the winch so that the winch can be used to move the platform between a lower configuration and an elevated configuration, wherein the first, second, third and fourth ropes are attached together prior to attachment to the winch; and a side wall that extends from the platform to form an enclosure, wherein the side wall has a height of between about 6 inches and about 24 inches.

7. The household object storage system of claim 6, wherein the side wall is operably attached to the platform for positioning in a use configuration and a storage configuration.

8. The household object storage system of claim 1, and further comprising at least one security strap having a first end and a second end, wherein the first end is attachable to the building and wherein the second end is capable of engaging the platform when the platform is in the elevated configuration to retain the platform in the elevated configuration.

9. The household object storage system of claim 1, wherein at least one of the first, second, third and fourth platform attachments and the first, second, third and fourth building attachments is a pulley.

10. The household object storage system of claim 1, wherein the winch comprises a handle that is operably attached to a spool around which the first, second, third and fourth ropes extend.

11. A method of storing household objects in an elevated position within a building, wherein the method comprises:

providing a platform having a surface upon which at least one household object can be placed;

attaching a first, a second, a third and a fourth platform attachment to the platform;

attaching a first, a second, a third and a fourth building attachment to the building;

attaching a winch to the building;

operably engaging the first platform attachment, the first building attachment and the winch with a first rope;

operably engaging the second platform attachment, the second building attachment and the winch with a second rope;

operably engaging the third platform attachment, the third building attachment and the winch with a third rope;

operably engaging the fourth platform attachment, the fourth building attachment and the winch with a fourth rope;

attaching together the first, second, third and fourth ropes prior to attachment to the winch;

placing at least one object on the platform; and moving the platform between a lower configuration and an elevated configuration with the winch.

12. The method of claim 11, and further comprising fabricating the platform in at least two sections and pivotally attaching the platform sections to each other.

13. The method of claim 11, and further comprising providing a side wall that extends from the platform and wherein the side wall is operably attached to the platform for positioning in a use configuration and a storage configuration.

14. The method of claim 11, wherein at least one of the first, second, third and fourth platform attachments and the first, second third and fourth building attachments is a pulley.

* * * * *